US012012811B1

(12) United States Patent
Jacob et al.

(10) Patent No.: US 12,012,811 B1
(45) Date of Patent: Jun. 18, 2024

(54) CONTROLLING SURFACE PRESSURE DURING WELL INTERVENTION

(71) Applicant: Halliburton Energy Services, Inc., Houston, TX (US)

(72) Inventors: Roshan Jacob, Cypress, TX (US); Oluwatosin Ogundare, Houston, TX (US); Philippe Quero, Houston, TX (US); Charles Lynn Mouser, Duncan, OK (US); Jeremy C. Nicholson, Houston, TX (US); Radovan Rolovic, Sugar Land, TX (US); Eric Lynn Jantz, Duncan, OK (US); Robert Eugene Domann, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 18/082,682

(22) Filed: Dec. 16, 2022

(51) Int. Cl.
*E21B 21/08* (2006.01)
*E21B 19/22* (2006.01)

(52) U.S. Cl.
CPC ..... *E21B 21/08* (2013.01); *E21B 19/22* (2013.01); *E21B 2200/22* (2020.05)

(58) Field of Classification Search
CPC ..... E21B 21/08; E21B 19/22; E21B 2200/22
See application file for complete search history.

(56) References Cited

U.S. PATENT DOCUMENTS 6,102,673 A * 8/2000 Mott ..... E21B 43/36 251/324
6,230,824 B1 * 5/2001 Peterman ..... F04B 19/003 166/359
6,325,159 B1 * 12/2001 Peterman ..... E21B 21/08 166/359
7,032,499 B2 * 4/2006 Domann ..... E21B 33/08 166/77.3
11,566,479 B1 * 1/2023 Ogundare ..... E21B 19/22
2003/0106712 A1 * 6/2003 Bourgoyne ..... E21B 21/08 166/358

(Continued)

OTHER PUBLICATIONS

International Patent Application No. PCT/US2022/053604, International Search Report and Written Opinion mailed Sep. 1, 2023, 9 pages.

*Primary Examiner* — Steven A MacDonald
(74) *Attorney, Agent, or Firm* — Kilpatrick Townsend & Stockton LLP

(57) ABSTRACT

A system for controlling pressure applied in a well intervention operation using a physics-based model is provided. The system can include a stripper element that includes a pressure retention element for sealing a wellbore during an intervention operation that uses coiled tubing; a stripper circuit that includes a hydraulic actuator to apply a pressure to the pressure retention element; a processing device coupled to the hydraulic actuator that can receive, from the stripper circuit, a feedback signal. The processing device may receive a physical characteristic of a component and then determine, using data from the feedback signal and the physical characteristic, a minimum pressure level to contain wellhead pressure. The processing device may then output a command to cause the hydraulic actuator to change the pressure on the pressure retention element to be the minimum pressure level or within a pre-set deviation of the minimum pressure level.

20 Claims, 3 Drawing Sheets

(56) References Cited

U.S. PATENT DOCUMENTS

| | | | | |
|---|---|---|---|---|
| 2003/0217849 | A1* | 11/2003 | Hosie | E21B 33/03 166/373 |
| 2006/0144622 | A1* | 7/2006 | Bailey | E21B 47/10 175/230 |
| 2008/0210471 | A1* | 9/2008 | Bailey | E21B 34/16 175/48 |
| 2011/0024195 | A1* | 2/2011 | Hoyer | E21B 21/10 166/386 |
| 2014/0138094 | A1* | 5/2014 | Hannegan | E21B 47/06 166/57 |
| 2015/0136407 | A1* | 5/2015 | Bailey | E21B 19/004 166/335 |
| 2015/0167415 | A1* | 6/2015 | Leuchtenberg | E21B 21/067 137/155 |
| 2019/0226295 | A1* | 7/2019 | Zonoz | C09K 8/422 |
| 2020/0048991 | A1* | 2/2020 | Arteaga | E21B 47/06 |
| 2020/0284142 | A1* | 9/2020 | Haslanger | E21B 43/0122 |
| 2020/0386066 | A1* | 12/2020 | Brana | E21B 21/062 |
| 2021/0062635 | A1* | 3/2021 | Ameen | E21B 44/04 |
| 2022/0243585 | A1* | 8/2022 | Hashim | G01M 3/223 |
| 2022/0282615 | A1* | 9/2022 | Alghazali | E21B 47/06 |

* cited by examiner

CONTROLLING SURFACE PRESSURE DURING WELL INTERVENTION

TECHNICAL FIELD

The present disclosure relates generally to wellbore intervention operations and, more particularly (although not necessarily exclusively), to controlling surface pressure during well intervention operations.

BACKGROUND

A wellbore can be formed in a subterranean formation at a wellsite for extracting produced hydrocarbon or other suitable material. A wellbore operation, such as a production operation, can be performed at the wellsite to extract the produced hydrocarbon material or perform other suitable tasks relating to the wellbore. During the lifetime of a well, well intervention may be necessary to increase or maintain well performance, using technologies such as coiled tubing, slickline, wireline, or hydraulic workover (snubbing). Pressure control equipment may be operated during well intervention to seal wellbore fluids in the well. Applying the proper amount of pressure control during a well intervention to avoid damaging equipment or reducing the lifetime of the equipment can be challenging.

DETAILED DESCRIPTION

Figure 1:
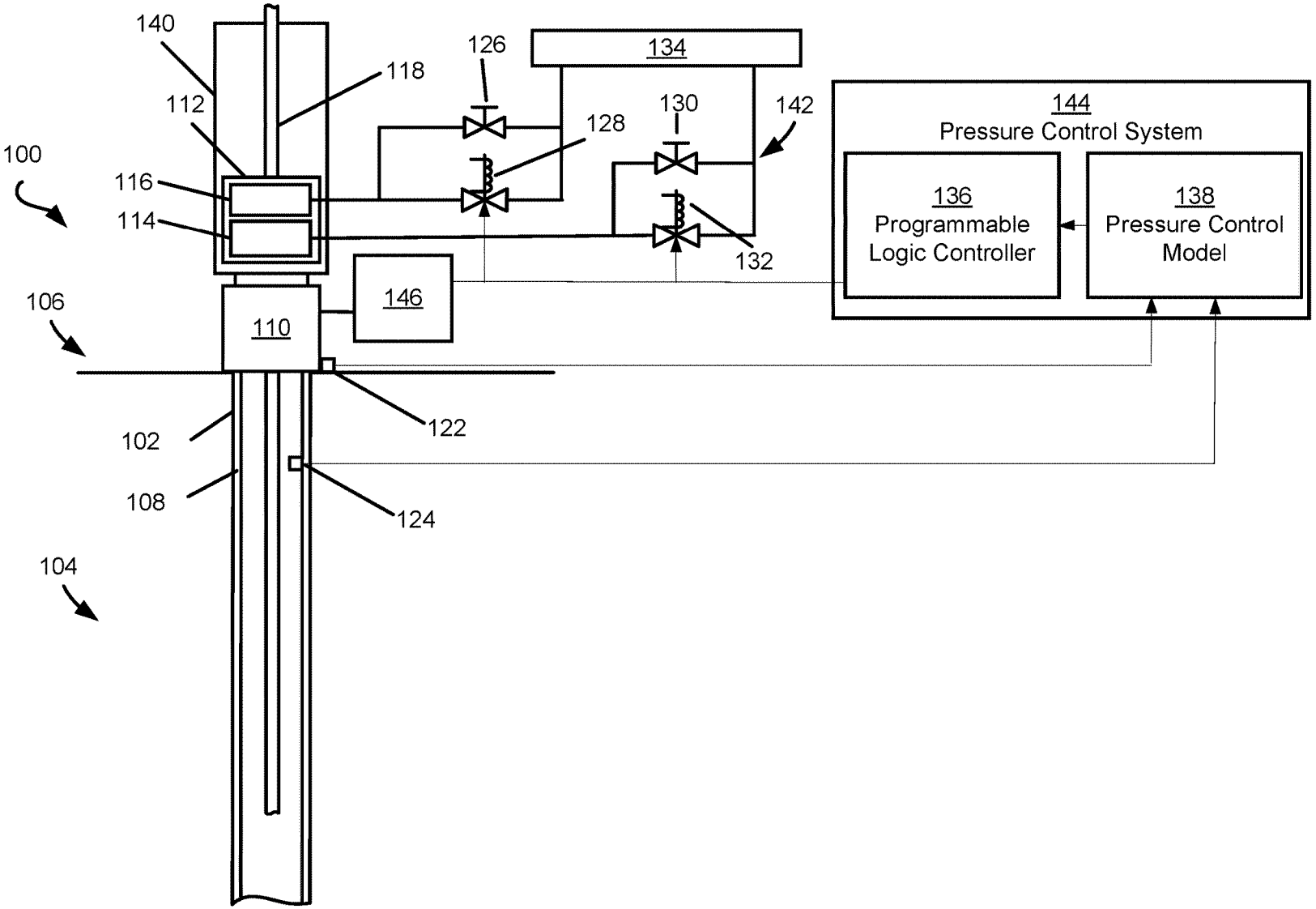
FIG. 1 is a schematic of a wellbore that includes a system for controlling pressure applied in a well intervention operation using a physics-based model according to some aspects of the present disclosure.

Certain aspects and examples of the present disclosure relate to controlling pressure applied in a well intervention operation by accounting for physical and other parameters about the wellbore, well intervention equipment, and other parameters. The amount of pressure applied in the well intervention operation may be automatically controlled based on the amount of pressure determined using a physics-based model. A wellbore may include at least one piece of physical equipment at the surface to prevent high-pressure fluids from escaping the wellbore. For example, during coiled tubing operations, coiled tubing may be gripped and advanced, or stripped, into a wellbore. The coiled tubing may be run into the wellbore, for example, to pump gases or liquids into the wellbore to improve well performance. To seal off wellbore fluids from the surface as the coiled tubing is moving, a stripper may be used. The stripper may be positioned above the wellhead and may utilize a hydraulic actuated cylinder to compress an elastomer (e.g., rubber) against the coiled tubing to seal wellbore fluids while the tubing is being ran into or removed from the well. The hydraulic actuated cylinders may be controlled using a stripper hydraulic circuit connected thereto. The stripper hydraulic circuit may have a constant supply of hydraulic pressure during well operation. The hydraulic pressure may be adjusted to seal the stripper from well fluid leaks, while avoiding over pressure, which may otherwise damage the equipment. Adjusting the pressure on the stripper circuit may be performed using a control system. By accounting for physical and other parameters about the well and equipment when determining an amount of pressure to apply, under pressure and over pressure can be avoided and equipment life can be extended.

Other processes control an amount of pressure manually using knowledge and experience of the operator. Manually controlling stripper hydraulic pressure can be disadvantageous. Manual operators may apply too much pressure to stripper circuits, leading to accelerated wear and damage to equipment, without increasing safety. In addition, manual operation may be undocumented or non-standardized, resulting in variable application of pressure from wellsite to wellsite and inconsistencies while training personnel. Finally, when the stripper is operated improperly, the release of hydrocarbons at wellsites may occur, resulting in potential safety and environmental hazards. A control system may improve on manual control by using physics-based and statistical modeling to calculate a safe pressure to apply to the stripper using a variety of available information. This approach may reduce equipment wear and damage by correcting the tendency to manually overpressure the stripper, resulting in greater cost effectiveness to the customer. It may also eliminate the need for personnel to manually control stripper pressure with inadequate or non-standardized training, as well as reducing training time. Finally, using a control system may enhance wellsite safety by reducing the risk of well fluids from escaping the wellbore.

Electro-hydraulic valves along with an associated control system can be used to control the pressure supplied to the stripper. The pressure control system may receive commands from a control calculation performed by a physics-based model. The control calculation can calculate a minimum, a maximum, and a target level of pressure that is to be supplied to the stripper. Thus, the system's applied hydraulic pressures may be range-bound within a minimum and maximum range. The minimum and maximum ranges may be a particular percentage pre-set deviation from the target level of pressure. The control calculation of minimum pressures may be based on numerous factors including, for example, the desired wellhead pressure to be contained. Likewise, the control calculation of maximum pressure may depend on the maximum pressure above which coiled tubing pipe damage may result, among many other factors. The control calculation may also incorporate historical data from other wellsites or jobs at the current wellsite obtained in similar conditions.

The pressure control system may incorporate inputs from a feedback signal. The feedback signals may be electric, hydraulic, pneumatic, or other suitable medium. The feedback signal may correspond to electro-hydraulic valve position and may be related to stripper applied hydraulic pressure, among other possible relationships. In this way, the feedback signal may be provided to the pressure control system, which may use the feedback signal to position the electro-hydraulic value to control hydraulic flow and therefore the hydraulic pressure applied to the stripper pressure retention elements.

The pressure control system may also incorporate inputs from a sensor. For example, the sensor may be a surface sensor, like a sniffer (gas leak detector), which may be used to detect well fluids escaping at the surface due to an improperly set stripper pressure. Actuators and other instrumentation may also provide inputs to the control system. For example, inputs from actuators and other instrumentation may include valve positions, pressure detector readings, or flow rate detector outputs. The control system may also incorporate a physics-based model to calculate the necessary pressure to be applied to the pressure retention, or packer, elements. The physics-based model may consider numerous parameters, including, for example, the physical properties of the pressure retention elements. The control system may also incorporate a statistical learning model based on historical data or learnings. The statistical learning model may include a machine learning model. The statistical learning model may be continuously adjusted based on, for example, sensor inputs. The control system may also incorporate operator input. For example, the control system may be able to receive a pressure setpoint from a system operator that can be used to adjust the pressure modulation range. These example inputs may be used to apply/modulate hydraulic stripper pressure.

In addition to pressure control, the control system may control additional wellsite features, resulting in improved safety, reduced training time, and better cost effectiveness. For example, the control system may automatically actuate a lubrication system to reduce friction between the pressure retention elements of the stripper and coiled tubing. The control system may include automatically stopping coiled tubing and/or activating appropriate rams in the blowout preventer (BOP) based on classifying hazards or detecting gases persisting at the surface beyond a certain predetermined time. The control system may include the ability to automatically stop pumps. The control system may also activate visual or audible alarms, or other notifications.

The workflow for controlling the stripper pressure circuit, as well as the additional wellsite features, may be managed through an automated decision tree processing module. The decision tree processing module may receive numerous inputs including, for example, current equipment state and hydraulic pressures. The inputs may be processed through such modules as a leak identification module, a quantification module, or a classification system to automate pressure control system actions. Automated control system actions may include, for example, adjusting stripper operating pressures, notifications, or stop procedures.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore 102 that includes a system for controlling pressure applied in a well intervention operation using a physics-based model according to some aspects of the present disclosure. As depicted in FIG. 1, the wellsite 100 includes a wellbore 102 drilled through a subterranean formation 104. The wellbore 102 extends from a well surface 106 into strata of the subterranean formation 104. The strata can include different materials (e.g., rock, soil, oil, water, or gas) and can vary in thickness and shape. In some examples, the wellsite 100 may include more than one wellbore 102. Additionally, the wellbore 102 can be vertical as depicted, deviated, horizontal, or any combination of these.

The wellbore 102 can be cased, open-hole, or a combination of these. For example, a casing string 108 can extend from the well surface 106 through the subterranean formation 104. The casing string 108 may provide a conduit through which formation fluids, such as production fluids produced from the subterranean formation 104, can travel from the wellbore 102 to the well surface 106. In some examples, the casing string 108 can be coupled to the walls of the wellbore 102 via cement. For example, a cement sheath can be positioned or formed between the casing string 108 and walls of the wellbore 102 for coupling the casing string 108 to the wellbore 102.

The wellhead 110 may be welded onto the casing string 108 to provide a structural and pressure-containing interface with production equipment. During the production phase of well lifecycle, a well intervention operation may be carried out to perform maintenance on the well, increase production, extend lifetime, or other reasons. Coiled tubing 118 may be pushed into the wellbore 102 through the wellhead 110 to pump or circulate gas or liquid chemicals during intervention operations. In some examples, coiled tubing 118 may also be used in conjunction with drilling and production activities and is not limited to well intervention. A coiled tubing injector 140 may be used to grip and advance coiled tubing 118 into a wellbore 102 via a wellhead 110. The coiled tubing injector 140 may utilize a stripper element 112 to seal off and hold wellbore 102 fluids in the well. The stripper element 112 may be positioned above the wellhead 110. The stripper element 112 may utilize a hydraulic actuated cylinder to press stripper pressure retention elements against the coiled tubing 118 while the coiled tubing 118 is being inserted into or removed from the well, or is stationary inside the wellhead 110, thereby sealing the wellhead 110 and preventing wellbore fluids from escaping the well. The pressure retention elements of the stripper element 112 may be an elastomer like rubber. The hydraulic actuated cylinder in the stripper element 112 are controlled using a hydraulic stripper circuit 142. The stripper element 112 may include a primary stripper 114 and a secondary stripper 116. The secondary stripper 116 may be available as a backup in the event the primary stripper 114 fails or must be accessed for maintenance. In addition to coiled tubing 118, the stripper element 112 may be used with other forms of well intervention technologies that also require insertion or withdrawal of string, tubing, or the like through the wellhead 110 while wellhead pressure is contained. For example, a stripper element 112 may be used with wireline, slickline, braided line, during snubbing (hydraulic workover), or other intervention operations that have similar operating principles to those described herein with respect to coiled tubing 118.

The hydraulic stripper circuit 142 maintains hydraulic pressure on the hydraulic actuated cylinder in the stripper element 112. For example, hydraulic pressure may be maintained using manual valves 126, 130 to apply pressure from a hydraulic supply system 134. In some examples, electro-hydraulic valves 128, 132 may be used to apply pressure from the hydraulic supply system 134. The wellsite 100 may include a switching valve (not shown) to allow for switching between manual and electro-hydraulic control of the hydraulic stripper circuit pressure. The electro-hydraulic valves 128, 132 may be solenoid-operated valves, as shown, but may include other types of actuation mechanisms, such as pneumatic or hydraulic actuation. The hydraulic stripper circuit 142 may also include an emergency set circuit, which can quickly increase the pressure applied to the hydraulic actuated cylinder in the stripper element 112 in the event of an unexpected leak. An emergency set circuit may include a safety mechanism intended to operate a system quickly if the system cannot be operated in the usual manner. For example, an emergency set circuit may include an electric switch or short circuit that bypasses safeguards or interlocks.

The electro-hydraulic valves 128, 132 may be controlled using a pressure control system 144. The pressure control system 144 may include a pressure control model 138 that performs a control calculation, which can be used to set the pressure supplied to the stripper element 112. In some examples, the pressure can be adjusted within a range to meet stripper element 112 demands such as the minimum hydraulic cylinder actuation pressure used to seal the stripper element 112 from well-fluid leaks. The adjustable pressure may be supplied to the hydraulic actuation cylinders to compress the pressure retention elements of the stripper element 112 against the coiled tubing 118 to seal wellbore fluids in the well while the coiled tubing 118 is moving or stationary. The pressure control model 138 may output the result of the control calculation to a programmable logic controller 136. The programmable logic controller 136 may output a control signal to the electro-hydraulic valves 128, 132 to cause changes to the hydraulic stripper circuit 142 including, but not limited to, operational adjustments to stripper pressure and stops. The pressure control system 144 may include actuators and instrumentation necessary to apply and modulate hydraulic pressure to affect the operational adjustments and stops. The pressure control system 144 may also create a safety notification because of the control calculation. For example, the safety notifications may include visual alarms or audible alarms, or any other suitable medium for appraising operators of the safety notifications.

In some examples, the pressure control model 138 may receive inputs from a sensor 122. The sensor 122 may include a sensor on the surface of the wellsite 100 (a surface sensor) or a downhole sensor 124. For example, surface sensor may include a sniffer (gas detector) to detect the presence of gas at the wellhead 110, indicating wellbore fluids potentially leaking to the surface. The surface sensor may include infrared cameras to detect the presence of high temperatures at the wellhead 110, indicating wellbore fluids potentially leaking to the surface. Other surface sensors may be pressure sensors or transducers and sensors to measure the wear of the pressure retention elements of the stripper element 112. In some examples, the surface sensor may produce a surface sensor output, which can provide an input to the pressure control model 138. The pressure control model 138 may also receive inputs from downhole sensors 124, which are located inside the wellbore 102. For example, the downhole sensors 124 may include pressure sensors that monitor the wellhead pressure.

Many other types, locations, and combinations of sensors may be used with outputs from the sensors used as input to the pressure control model 138. The sensor 122 may include optical instruments such as cameras, lasers, and telescopic lenses, for gathering visual data. The sensor 122 may include wireless electronics, such as antennas, transmitters, and receivers, for receiving instructions, sending instructions, or executing automatic identification and data capture in the case of RFID chips, smart cards, biometrics, or magnetic strips. The sensor 122 may include lasers, acoustic sensors, ultrasonic sensors, gyroscopes, accelerometers, compasses, capacitive proximity sensors, inductive proximity sensors, shock sensors, RADAR, LIDAR, and GPS. The sensor 122 may include gas detectors to detect combustible, flammable, and toxic gases as well as oxygen depletion. For example, the sensor 122 may include a carbon monoxide detector, an oxygen detector, a hydrogen sulfide detector, and a combustibles detector. The sensor 122 may also include instruments for measuring properties of fluids (e.g., drilling fluids) and equipment at the wellsite 100. For example, the sensor 122 can include instruments for measuring temperature, angle, inclination, pressure, rotation speed, viscosity, water content, hydrocarbon content, density, additive formulation, lost-circulation material content, thermal capacity, thermal conductivity, or salinity. The sensor 122 may include force sensors (e.g., pressure sensors, torque sensors, or strain sensors) for measuring forces present on the stripper element 112 or other equipment.

In some examples, the pressure control system 144 may provide outputs for other actuators 146. In some examples, in addition to controlling stripper hydraulic actuator pressure the pressure control system 144 may monitor for wellhead leaks occurring due to a wellhead overpressure condition. An overpressure condition may occur when stripper hydraulic actuator pressure falls below the minimum pressure level used to contain wellhead pressure. The other actuators 146 may include an overpressure actuator associated with an overpressure backup component. For example, the pressure control system 144 could activate a secondary stripper 116, an automatic stripper lubrication system, a secondary stripper circuit, or blowout preventor (BOP) rams according to the control calculation of the pressure control model 138. In some examples, the sensor 122 may include a leak sensor or stripper leak detection system, which may provide inputs to the pressure control model 138 to perform other actions, such as actuating one of the other actuators 146.

Figure 2:
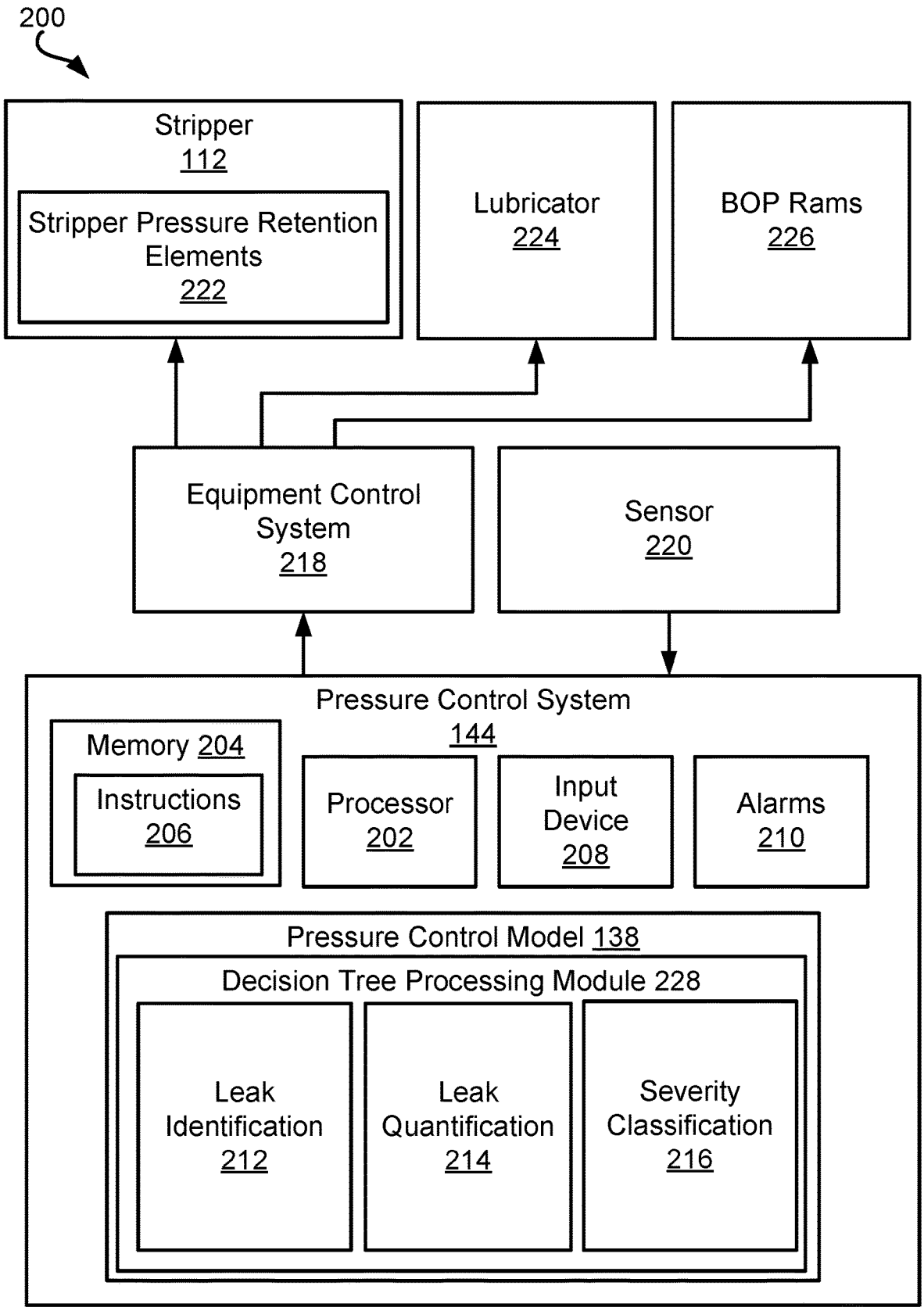
FIG. 2 is a block diagram of a system for controlling pressure applied in a well intervention operation using a physics-based model according to some aspects of the present disclosure.

FIG. 2 is a block diagram of a system 200 for controlling pressure applied in a well intervention operation using a physics-based model according to some aspects of the present disclosure. The pressure control system 144 can include a processor 202 communicatively coupled to a memory 204. The processor 202 is hardware that can include one processing device or multiple processing devices. Non-limiting examples of the processor 202 include a Field-Programmable Gate Array (FPGA), an application-specific integrated circuit (ASIC), or a microprocessor. The processor 202 can execute instructions 206 stored in the memory 204 to perform computing operations. The instructions 206 may include processor-specific instructions generated by a compiler or an interpreter from code written in any suitable computer-programming language, such as C, C++, C#, Python, or Java.

The memory 204 can include one memory device or multiple memory devices. The memory 204 can be volatile or can be non-volatile, such that it can retain stored information when powered off. Some examples of the memory 204 can include electrically erasable and programmable read-only memory (EEPROM), flash memory, or any other type of non-volatile memory. At least some of the memory 204 includes a non-transitory computer-readable medium from which the processor 202 can read instructions 206. A computer-readable medium can include electronic, optical, magnetic, or other storage devices capable of providing the processor 202 with computer-readable instructions or other program code. Some examples of a computer-readable medium include magnetic disks, memory chips, ROM, random-access memory (RAM), an ASIC, a configured processor, optical storage, or any other medium from which a computer processor can read the instructions 206.

The pressure control system 144 can include an input device 208. The input device 208 may include suitable hardware or software for collecting user input and operating the system 200. For example, the input device 208 may include a keyboard, mouse, trackpad, smartphone screen, tablet screen, or the like. The input device 208 may be used to receive a target pressure setpoint from a user of the system about which stripper hydraulic control pressure can be modulated within a minimum range or a maximum range. The minimum range and the maximum range may be a particular percentage pre-set deviation from the target pressure setpoint. For example, the minimum range may be 5% below the target pressure setpoint and the maximum range may be 5% above the target pressure setpoint.

The processor 202 may be communicatively coupled to an equipment control system 218. The equipment control system 218 may include the actuation devices used to maintain and adjust stripper hydraulic pressure. For example, the equipment control system 218 may include the solenoid actuators for the electro-hydraulic valves 128, 132. The control calculation of the pressure control model 138 may be used by the equipment control system 218 to increase or decrease the hydraulic pressure applied to the pressure retention elements 222 of the stripper element 112. The equipment control system 218 may also utilize the control calculation of the pressure control model 138 to operate other equipment using an actuator mechanism, including the lubrication system 224 and the BOP rams 226. The lubrication system 224 may be automatically actuated to reduce friction between the pressure retention elements 222 of the stripper element 112 and coiled tubing 118. The BOP rams 226 may be automatically activated based on classifying hazards or detecting gases persisted beyond a certain amount of time at the surface 106. Other automatically actuated equipment may include stopping coiled tubing 118 from being inserted or removed, stopping pumps, or activating alarms 210. The alarms 210 may be visible or audible alarms. Other types of equipment may also or alternatively be actuated by the equipment control system 218.

The processor 202 may also be communicatively coupled to a sensor 220. Examples of a sensor 220 that may be used in the system 200 includes a sniffer (gas detector), infrared camera, pressure sensors, pressure transducers, sensors to measure pressure retention element wear, equipment instrumentation, and or a stripper leak detection system. Other types of sensors can also be used including, for example, surface sensors or leak sensors. The sensor 220 may provide inputs to the pressure control model for 138 for use in the control calculation.

The processor 202 can execute instructions 206 to operate a pressure control model 138 to perform a control calculation. The control calculation can be used to determine a minimum level of pressure, a maximum level of pressure, or a target level of pressure that may be supplied to the pressure retention elements 222 of the stripper element 112. The minimum level of pressure and the maximum level of pressure may correspond to percentage pre-set deviations from the target level of pressure. For example, the minimum level of pressure may be 5% below the target level of pressure and the maximum level of pressure may be 5% above the target level of pressure. The target level of pressure may be set according to a user input received through the input device 208, and then modulated within a minimum range or a maximum range. In another example, the target level of pressure may be determined by the pressure control model 138 rather than being received from user input. The pressure control model 138 may determine the minimum pressure level according to physical characteristics of components used in the intervention operation such as the wellhead pressure to be contained; the types and characteristics of the valves making up the hydraulic stripper circuit 142; the minimum stripper pressure to wipe fluid and solid deposits from the coiled tubing 118 while withdrawing from the wellbore 102; the physical dimensions of the coiled tubing 118 (e.g., tubing diameter and wall thickness); the physical characteristics of the coiled tubing 118 such as the strength of the coiled tubing 118; the current depth of the coiled tubing 118; the type and design of the stripper element 112, such as the properties of the sealing element for the stripper element 112 and the configuration of the stripper element 112; the type and properties of the wellhead fluid to be sealed; the current pressure applied to the pressure retention elements 222 of the stripper element 112; and the minimum operating pressure of the hydraulic control circuit of the stripper element 112. The pressure control model 138 may be used to determine the maximum pressure according to factors and conditions such as, but not limited to, the maximum pressure above which the coiled tubing pipe may be damaged (e.g., the coiled tubing pipe collapse pressure); the maximum rated pressures for the stripper element 112 used; and the maximum operating pressure of the stripper element 112 hydraulic control system.

The pressure control model 138 may include a physics-based model used to determine the pressure to be applied to the pressure retention elements 222 of the stripper element 112. Some examples of parameters the physics-based model may include as inputs to the control calculation are the material of the pressure retention elements 222 of the stripper element 112; the diameter of the wellbore 102; coiled tubing 118 properties including diameter, wall thickness, material, and roughness; lubrication levels; speed of coiled tubing 118 movement; and wellhead pressure, both above and below the pressure retention elements 222 of the stripper element 112. The physics-based model may include any number of other parameters as well.

The pressure control model 138 can be augmented with a statistical learning model that is based on historical data. The pressure control model 138 can then be continuously adjusted based on inputs from feedback signal, the sensor 220, or other suitable inputs. Additionally, the pressure control model 138 may also incorporate historical data from stripper operations performed under similar conditions.

In some examples, the pressure control model 138 includes a learning module. The learning module may be an implemented as a machine learning model, such as an automated decision tree processing module 228, but may include other implementations such as a neural network, support vector machine, or naive classifier. The machine learning model may be trained in a supervised, unsupervised, or semi-supervised manner. Training the machine learning model may include data such as current operating data, historical operating data, operating data from other wellsites, or any other suitable data.

The inputs to the automated decision tree processing module 228 may include equipment physical properties; equipment current state and hydraulic pressures; environmental condition; operating conditions; and measured data relating to leaks, among others. The inputs may be processed through a leak identification module 212, a leak quantification module 214, and a leak severity classification module 216 to determine the next control action. Control actions may include adjusting stripper element 112 operating pressures, notification via alerts or alarms 210, and stop procedures. The alarms 210 may include visual, audible, or other types of alarms or notifications. According to the event classification performed by the leak severity classification module 216, the pressure control model 138 may cause the equipment control system 218 to activate equipment such as a secondary stripper 116, a lubrication system 224, or the BOP rams 226.

Figure 3:
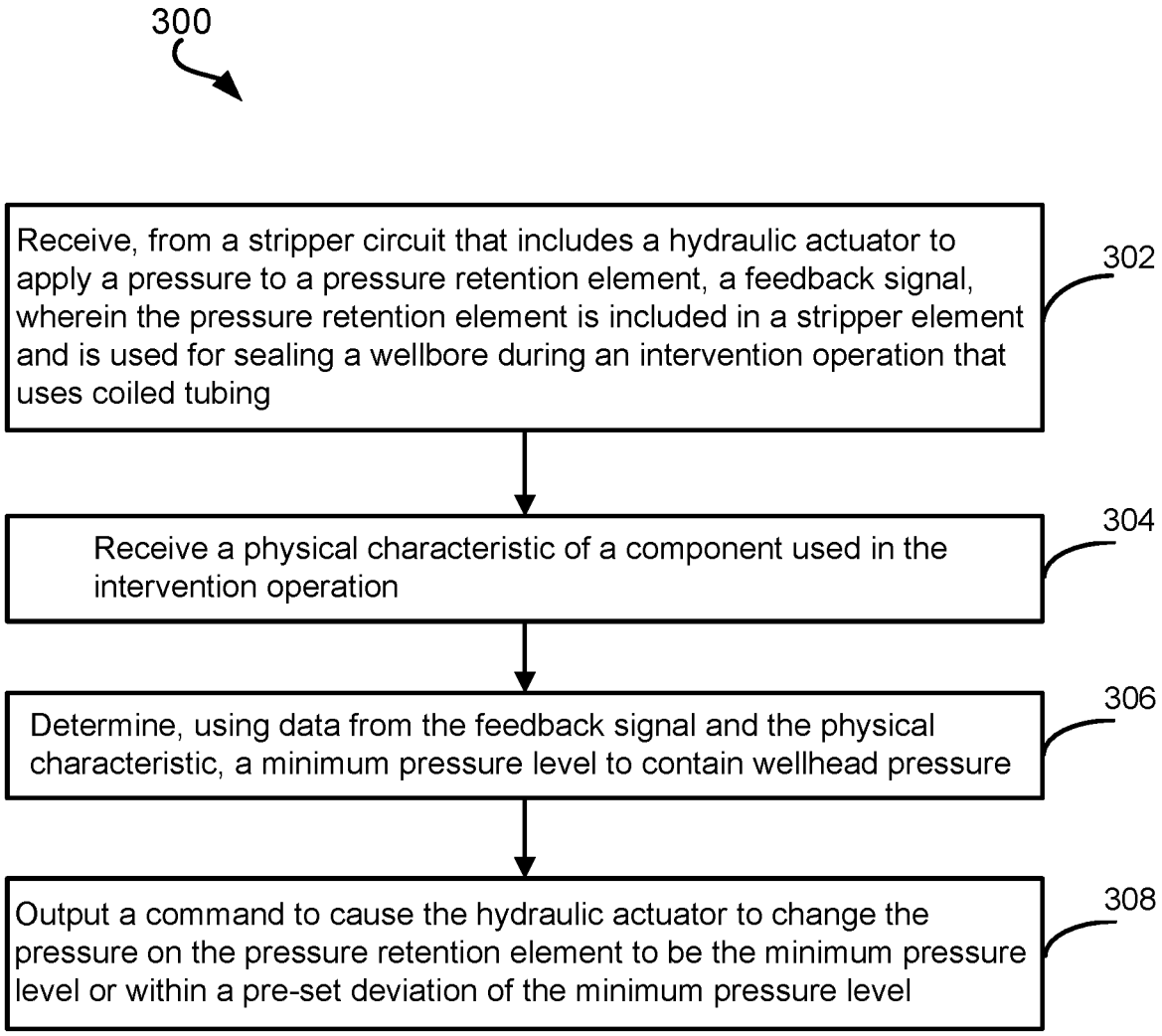
FIG. 3 is a flowchart of a process for controlling pressure applied in a well intervention operation using a physics-based model according to some aspects of the present disclosure.

FIG. 3 is a flowchart of a process for controlling pressure applied in a well intervention operation using a physics-based model according to some aspects of the present disclosure. The process shown in FIG. 3 is described with reference to the components of FIGS. 1-2, but other configurations are also possible.

In block 302, the processor 202 may receive from a stripper circuit that includes a hydraulic actuator to apply a pressure to a pressure retention element 222, a feedback signal, wherein the pressure retention element 222 is included in a stripper element 112 and is used for sealing a wellbore during an intervention operation that uses coiled tubing 118. The feedback signal may be mechanical, electrical, pneumatic, hydraulic, or any other suitable mechanism for determining the current state of the stripper element 112 relative to the desired configuration. For example, a hydraulic feedback cylinder may be used to represent the configuration of the hydraulic actuators. The feedback signal may be indicative of some configuration of the hydraulic stripper circuit 142 that corresponds to the pressure applied to the pressure retention elements 222 of the stripper element 112. For example, the feedback signal may be related to the position of the electro-hydraulic valves 128, 132, or some other physical or logical state of the hydraulic stripper circuit 142.

In block 304, the processor 202 may receive a physical characteristic of a component used in the intervention operation. In some examples, the processor 202 may be included in a pressure control system 144 which may include a pressure control model 138. The pressure control model 138 may include a physics-based model. The physics-based model may receive either or both of the feedback signal and a physical characteristic of a component used in the intervention operation including, but not limited to, wellhead pressure; valve properties; coiled tubing dimensions (e.g. tubing diameter and wall thickness); coiled tubing depth; coiled tubing strength; operating parameters such as the minimum and maximum stripper design pressures; the minimum and maximum design pressures of the hydraulic stripper circuit 142; the current pressure applied to stripper, as well as characteristics of other components used in the intervention operation. These inputs may be accessed from the memory 204, they may be received as user input, via the input device 208, through communicative couplings to other components of the system 200, or any other suitable input mechanism.

In block 306, the processor 202 may determine, using data from the feedback signal and/or the physical characteristic, a minimum pressure level to contain wellhead pressure. The processor 202 may convert, using a suitable procedure, feedback signal into another form, prior to inputting it to the pressure control model 138. For example, a voltage associated with a hydraulic feedback cylinder or valve position indication mechanism may be converted into a numeric valve stem position that may be used in a control calculation. Other mappings between inputs to the pressure control model 138 and feedback signal and/or physical characteristic are possible.

The pressure control model 138 may calculate the necessary pressure to be applied to the pressure retention elements 222 of the stripper element 112 using the hydraulic actuators. The pressure control model 138 may perform a control calculation that may include the minimum pressure used to seal the pressure retention elements around the coiled tubing 118 to contain wellhead pressure. The control calculation may also include any necessary adjustments needed to modulate the pressure applied to the pressure retention elements 222 of the stripper element 112 inside a minimum and maximum pressure range. The minimum and maximum pressure range may be calculated to be a percentage pre-set deviation from the minimum pressure level to contain wellhead pressure. For example, the minimum pressure range may be 5% below the minimum pressure level to contain wellhead pressure and the maximum range may be 5% above the minimum pressure level to contain wellhead pressure.

In block 308, the processor 202 may output a command to cause the hydraulic actuator to change the pressure on the pressure retention element 222 to be the minimum pressure level or within a pre-set deviation of the minimum pressure level. For example, the result of the control calculation performed by the pressure control model 138 may be mapped to movements of actuators. In one example, the actuators may include electro-hydraulic valves 128, 132 controlled by solenoids that may be adjusted to change the pressure applied to the stripper hydraulic actuators. As a result, the pressure applied to the pressure retention elements 222 of the stripper element 112 is changed. This change may result in pressure remaining above that minimum needed to contain wellhead pressure and below that maximum above which equipment damage or excessive wear may occur.

In some examples, the processor 202 may receive a sensor output in addition to or instead of the feedback signal. The processor 202 may perform, using the pressure control model 138, the control calculation incorporating the feedback signal and/or sensor outputs. The sensor 122 may include any suitable device for measuring surface or wellbore properties. For example, the sensor 122 may be a surface sensor or a leak sensor. The sensor 122 may be included in a stripper leak detection system.

In some examples, the processor 202 may receive a sensor output. For example, the sensor 122 may be a leak sensor. The processor 202 may determine, using the pressure control model 138, that an overpressure condition exists, according to the outputs from the leak sensor. For example, if a gas leaks from the stripper element 112, the gas may be detectable with a sniffer (gas detector). The presence of a gas outside the stripper element 112 may be indicative of a leak, which may warrant the deployment of an overpressure backup component. Overpressure backup components may include any equipment suitable to respond to a wellbore leak. For example, overpressure backup components may include actuators that automatically stop coiled tubing 118 insertion or withdrawal, automatically stop pumps, activate BOP rams 226, activate a secondary stripper 116, activate a lubrication system 224, or other suitable actions.

In some examples, the processor 202 may receive a leak sensor output and, using the pressure control model 138, further identify, quantify, and classify a wellhead leak. For example, if a gas leaks from the stripper element 112, the gas may be detectable with a sniffer. The presence of a gas outside the stripper element 112 may be indicative of a leak. After identifying that a wellhead leak may exist, the pressure control model 138 may then determine the magnitude of the leak by quantifying it. For example, based on a measured gas concentration, the pressure control model 138 may estimate the corresponding size of the leak. The pressure control model 138 may then classify the leak based on its magnitude and other data, for example, inputs from another sensor 122. The classification may be implemented using an automated decision tree processing module 228, but other suitable classification models are possible. The pressure control model 138 may respond to the leak by outputting commands to actuators. For example, the pressure control model 138 may output commands to the hydraulic actuators of the stripper element 112 to cause a change in stripper pressure that may be sufficient to respond to the leak. For a more substantial leak, the pressure control model 138 may output commands to actuators associated with overpressure backup components and automatically stop coiled tubing 118 insertion or withdrawal, stop pumps, activate BOP rams 226, activate a secondary stripper 116, activate a lubrication system 224, or other possible actions.

In some examples, the pressure control model 138 may also include a statistical learning model based on historical data or learnings. The statistical learning model may be implemented in a learning module comprising the pressure control model 138. In some examples, the statistical learning model can be a machine learning model. The machine learning model may be implemented by a decision tree, neural network, support vector machine, naive classifier, or other algorithm. The statistical learning model can receive the feedback signal. The statistical learning module can then generate, using the feedback signal, a trained statistical learning model, which can augment the pressure control model 138. In some examples, the statistical learning model can also receive inputs from a sensor 122, as well as other inputs. In some examples, the statistical learning model can also receive historical data from other similar wellsites or past examples from the wellsite 100. The statistical learning module can further augment the training machine learning model with these additional sources of training data. The statistical learning model may be trained prior to operation or may be continuously updated based as new training data is received.

In some examples, the processor 202 can identify, using the pressure control model 138, a lubrication deficit between the pressure retention elements 222 of the stripper element 112 and the coiled tubing 118. A lubrication deficit corresponds to insufficient lubrication to safely operate the pressure control system 144. The processor 202 may output commands causing a lubrication system actuator, comprising a lubrication system 224 configured to reduce friction between the pressure retention element and the coiled tubing, to reduce the lubrication deficit. For example, the lubrication system actuator may cause the lubrication system 224 to automatically apply lubrication to the stripper elastomer/coiled tubing contact surface, or to other wellhead components.

In some aspects, systems, methods, and non-transitory computer-readable mediums for controlling pressure applied in a well intervention operation using a physics-based model are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a stripper element that includes a pressure retention element for sealing a wellbore during an intervention operation that uses coiled tubing; a stripper circuit that includes a hydraulic actuator to apply a pressure to the pressure retention element; a processing device communicatively coupled to the hydraulic actuator; and a memory device including instructions that are executable by the processing device for causing the processing device to: receive, from the stripper circuit, a feedback signal; receive a physical characteristic of a component used in the intervention operation; determine, using data from the feedback signal and the physical characteristic, a minimum pressure level to contain wellhead pressure; and output a command to cause the hydraulic actuator to change the pressure on the pressure retention element to be the minimum pressure level or within a pre-set deviation of the minimum pressure level.

Example 2 is the system of example(s) 1, further comprising a surface sensor, wherein the memory device further includes instructions executable by the processing device for causing the processing device to: receive, from the surface sensor, a surface sensor output; input, to a pressure control model, the surface sensor output; and determine, using the pressure control model, the feedback signal, and the surface sensor output, a minimum pressure to contain wellhead pressure.

Example 3 is the system of example(s) 2, further comprising an overpressure backup component that includes an overpressure actuator, wherein memory device further includes instructions executable by the processing device for causing the processing device to: receive, from a leak sensor, a leak sensor output; input, to the pressure control model, the leak sensor output; determine, via the pressure control model and using the leak sensor output, a wellhead overpressure condition; and output commands to cause the overpressure actuator to contain the wellhead pressure.

Example 4 is the system of example(s) 3, wherein the memory device further includes instructions executable by the processing device for causing the processing device to: identify, using the pressure control model and the leak sensor output, a wellhead leak; quantify, using the pressure control model and the leak sensor output, a magnitude of the wellhead leak; classify, using the pressure control model and the leak sensor output, an event classification corresponding to a severity of the wellhead leak; and output commands to cause the hydraulic actuator and the overpressure actuator to respond to the wellhead leak with an action that is based on the severity of the wellhead leak.

Example 5 is the system of example(s) 2, wherein the pressure control model comprises a learning module, wherein the memory device further includes instructions executable by the processing device for causing the processing device to: input, to the learning module, the feedback signal; generate, by the learning module, a statistical learning model trained using the feedback signal, the statistical learning model trained to contain wellhead pressure; and input, to the pressure control model, the statistical learning model.

Example 6 is the system of example(s) 5, wherein the memory device further includes instructions executable by the processing device for causing the processing device to: access, from a memory, historical data; input, to the statistical learning model, the surface sensor output and the historical data; and generate, by the learning module, the statistical learning model trained using the feedback signal, the surface sensor output, and the historical data, the statistical learning model trained to contain wellhead pressure.

Example 7 is the system of example(s) 2, further comprising a lubrication system configured to reduce friction between the pressure retention element and the coiled tubing, including a lubrication system actuator, wherein the memory device further includes instructions executable by the processing device for causing the processing device to: identify, using the pressure control model and the feedback signal, a lubrication deficit; and output commands to cause the lubrication system actuator to reduce the lubrication deficit.

Example 8 is a method comprising: receiving, from a stripper circuit that includes a hydraulic actuator to apply a pressure to a pressure retention element, a feedback signal, wherein the pressure retention element is included in a stripper element and is used for sealing a wellbore during an intervention operation that uses coiled tubing; receiving a physical characteristic of a component used in the intervention operation; determining, using data from the feedback signal and the physical characteristic, a minimum pressure level to contain wellhead pressure; and outputting a command to cause the hydraulic actuator to change the pressure on the pressure retention element to be the minimum pressure level or within a pre-set deviation of the minimum pressure level.

Example 9 is the method of example(s) 8, further comprising: receiving, from a surface sensor, a surface sensor output; inputting, to a pressure control model, the surface sensor output; and determining, using the pressure control model, the feedback signal, and the surface sensor output, a minimum pressure to contain wellhead pressure.

Example 10 is the method of example(s) 9, further comprising: receiving, from a leak sensor, a leak sensor output; inputting, to the pressure control model, the leak sensor output; determining, via the pressure control model and using the leak sensor output, a wellhead overpressure condition; and outputting commands to cause an overpressure actuator to contain the wellhead pressure, wherein the overpressure actuator is included in an overpressure backup component.

Example 11 is the method of example(s) 10, further comprising: identifying, using the pressure control model and the leak sensor output, a wellhead leak; quantifying, using the pressure control model and the leak sensor output, a magnitude of the wellhead leak; classifying, using the pressure control model and the leak sensor output, an event classification corresponding to a severity of the wellhead leak; and outputting commands to cause the hydraulic actuator and the overpressure actuator to respond to the wellhead leak with an action that is based on the severity of the wellhead leak.

Example 12 is the method of example(s) 9, further comprising: inputting, to a learning module included in the pressure control model, the feedback signal; generating, by the learning module, a statistical learning model trained using the feedback signal, the statistical learning model trained to contain wellhead pressure; and inputting, to the pressure control model, the statistical learning model.

Example 13 is the method of example(s) 12, further comprising: accessing, from a memory, historical data; inputting, to the statistical learning model, the surface sensor output and the historical data; and generating, by the learning module, the statistical learning model trained using the feedback signal, the surface sensor output, and the historical data, the statistical learning model trained to contain wellhead pressure.

Example 14 is the method of example(s) 9, further comprising: identifying, using the pressure control model and the feedback signal, a lubrication deficit; and outputting commands to cause a lubrication system actuator, included in a lubrication system configured to reduce friction between the pressure retention element and the coiled tubing, to reduce the lubrication deficit.

Example 15 is a non-transitory computer-readable medium comprising instructions that are executable by a processing device for causing the processing device to perform operations comprising: receiving, from a stripper circuit that includes a hydraulic actuator to apply a pressure to a pressure retention element, a feedback signal, wherein the pressure retention element is included in a stripper element and is used for sealing a wellbore during an intervention operation that uses coiled tubing; receiving a physical characteristic of a component used in the intervention operation; determining, using data from the feedback signal and the physical characteristic, a minimum pressure level to contain wellhead pressure; and outputting a command to cause the hydraulic actuator to change the pressure on the pressure retention element to be the minimum pressure level or within a pre-set deviation of the minimum pressure level.

Example 16 is the non-transitory computer-readable medium of example(s) 15, wherein the operations further comprise: receiving, from a surface sensor, a surface sensor output; inputting, to a pressure control model, the surface sensor output; and determining, using the pressure control model, the feedback signal, and the surface sensor output, a minimum pressure to contain wellhead pressure.

Example 17 is the non-transitory computer-readable medium of example(s) 16, wherein the operations further comprise: receiving, from a leak sensor, a leak sensor output; inputting, to the pressure control model, the leak sensor output; determining, via the pressure control model and using the leak sensor output, a wellhead overpressure condition; and outputting commands to cause an overpressure actuator to contain the wellhead pressure, wherein the overpressure actuator is included in an overpressure backup component.

Example 18 is the non-transitory computer-readable medium of example(s) 17, wherein the operations further comprise: identifying, using the pressure control model and the leak sensor output, a wellhead leak; quantifying, using the pressure control model and the leak sensor output, a magnitude of the wellhead leak; classifying, using the pressure control model and the leak sensor output, an event classification corresponding to a severity of the wellhead leak; and outputting commands to cause the hydraulic actuator and the overpressure actuator to respond to the wellhead leak with an action that is based on the severity of the wellhead leak.

Example 19 is the non-transitory computer-readable medium of example(s) 16, wherein the operations further comprise: inputting, to a learning module included in the pressure control model, the feedback signal; generating, by the learning module, a statistical learning model trained using the feedback signal, the statistical learning model trained to contain wellhead pressure; and inputting, to the pressure control model, the statistical learning model.

Example 20 is the non-transitory computer-readable medium of example(s) 19, wherein the operations further comprise: accessing, from a memory, historical data; inputting, to the statistical learning model, the surface sensor output and the historical data; and generating, by the learning module, the statistical learning model trained using the feedback signal, the surface sensor output, and the historical data, the statistical learning model trained to contain wellhead pressure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a stripper element that includes a pressure retention element for sealing a wellbore during an intervention operation that uses coiled tubing;

a stripper circuit that includes a hydraulic actuator to apply a pressure to the pressure retention element;

a processing device communicatively coupled to the hydraulic actuator; and a memory device including instructions that are executable by the processing device for causing the processing device to:

receive, from the stripper circuit, a feedback signal;

receive a plurality of physical characteristics of one or more components used during the intervention operation;

determine, using the feedback signal and the plurality of physical characteristics input to a physics-based model, a minimum pressure level to contain wellhead pressure and a maximum pressure level configured to prevent damage to the coiled tubing; and output a command to cause the hydraulic actuator to change the pressure on the pressure retention element to maintain the pressure between the minimum pressure level and the maximum pressure level.

2. The system of claim 1, further comprising a surface sensor, wherein the memory device further includes instructions executable by the processing device for causing the processing device to:

receive, from the surface sensor, a surface sensor output;

input, to a pressure control model comprising the physics-based model, the surface sensor output; and update, using the pressure control model, the feedback signal, and the surface sensor output, the minimum pressure level to contain wellhead pressure.

3. The system of claim 2, further comprising an overpressure backup component that includes an overpressure actuator, wherein the memory device further includes instructions executable by the processing device for causing the processing device to:

receive, from a leak sensor, a leak sensor output;

input, to the pressure control model, the leak sensor output;

determine, via the pressure control model and using the leak sensor output, a wellhead overpressure condition; and output first commands to cause the overpressure actuator to contain the wellhead pressure.

4. The system of claim 3, wherein the memory device further includes instructions executable by the processing device for causing the processing device to:

identify, using the pressure control model and the leak sensor output, a wellhead leak;

quantify, using the pressure control model and the leak sensor output, a magnitude of the wellhead leak;

classify, using the pressure control model and the leak sensor output, an event classification corresponding to a severity of the wellhead leak; and output second commands to cause the hydraulic actuator and the overpressure actuator to respond to the wellhead leak with an action that is based on the severity of the wellhead leak.

5. The system of claim 2, wherein the pressure control model comprises a learning module, wherein the memory device further includes instructions executable by the processing device for causing the processing device to:

input, to the learning module, the feedback signal;

generate, by the learning module, a statistical learning model trained using the feedback signal, the statistical learning model trained to contain wellhead pressure; and input, to the pressure control model, the statistical learning model.

6. The system of claim 5, wherein the memory device further includes instructions executable by the processing device for causing the processing device to:

access, from a memory, historical data;

input, to the statistical learning model, the surface sensor output and the historical data; and generate, by the learning module, the statistical learning model trained using the feedback signal, the surface sensor output, and the historical data, the statistical learning model trained to contain wellhead pressure.

7. The system of claim 2, further comprising a lubrication system configured to reduce friction between the pressure retention element and the coiled tubing, including a lubrication system actuator, wherein the memory device further includes instructions executable by the processing device for causing the processing device to:

identify, using the pressure control model and the feedback signal, a lubrication deficit; and output commands to cause the lubrication system actuator to reduce the lubrication deficit.

8. A method comprising:

receiving, from a stripper circuit that includes a hydraulic actuator to apply a pressure to a pressure retention element, a feedback signal, wherein the pressure retention element is included in a stripper element and is used for sealing a wellbore during an intervention operation that uses coiled tubing;

receiving a plurality of physical characteristics of one or more components used in the intervention operation;

determining, using the feedback signal and the plurality of physical characteristics of the one or more components input to a physics-based model, a minimum pressure level to contain wellhead pressure and a maximum pressure level configured to prevent damage to the coiled tubing; and outputting a command to cause the hydraulic actuator to change the pressure on the pressure retention element to maintain the pressure between the minimum pressure level and the maximum pressure level.

9. The method of claim 8, further comprising:

receiving, from a surface sensor, a surface sensor output;

inputting, to a pressure control model comprising the physics-based model, the surface sensor output; and updating, using the pressure control model, the feedback signal, and the surface sensor output, the minimum pressure level to contain wellhead pressure.

10. The method of claim 9, further comprising:

receiving, from a leak sensor, a leak sensor output;

inputting, to the pressure control model, the leak sensor output;

determining, via the pressure control model and using the leak sensor output, a wellhead overpressure condition; and outputting first commands to cause an overpressure actuator to contain the wellhead pressure, wherein the overpressure actuator is included in an overpressure backup component.

11. The method of claim 10, further comprising:

identifying, using the pressure control model and the leak sensor output, a wellhead leak;

quantifying, using the pressure control model and the leak sensor output, a magnitude of the wellhead leak;

classifying, using the pressure control model and the leak sensor output, an event classification corresponding to a severity of the wellhead leak; and outputting second commands to cause the hydraulic actuator and the overpressure actuator to respond to the wellhead leak with an action that is based on the severity of the wellhead leak.

12. The method of claim 9, further comprising:

inputting, to a learning module included in the pressure control model, the feedback signal;

generating, by the learning module, a statistical learning model trained using the feedback signal, the statistical learning model trained to contain wellhead pressure; and inputting, to the pressure control model, the statistical learning model.

13. The method of claim 12, further comprising:

accessing, from a memory, historical data;

inputting, to the statistical learning model, the surface sensor output and the historical data; and generating, by the learning module, the statistical learning model trained using the feedback signal, the surface sensor output, and the historical data, the statistical learning model trained to contain wellhead pressure.

14. The method of claim 9, further comprising:

identifying, using the pressure control model and the feedback signal, a lubrication deficit; and outputting commands to cause a lubrication system actuator, included in a lubrication system configured to reduce friction between the pressure retention element and the coiled tubing, to reduce the lubrication deficit.

15. A non-transitory computer-readable medium comprising instructions that are executable by a processing device for causing the processing device to perform operations comprising:

receiving, from a stripper circuit that includes a hydraulic actuator to apply a pressure to a pressure retention element, a feedback signal, wherein the pressure retention element is included in a stripper element and is used for sealing a wellbore during an intervention operation that uses coiled tubing;

receiving a plurality of physical characteristics of one or more components used in the intervention operation;

determining, using the feedback signal and the plurality of physical characteristics of the one or more components input to a physics-based model, a minimum pressure level to contain wellhead pressure and a maximum pressure level configured to prevent damage to the coiled tubing; and outputting a command to cause the hydraulic actuator to change the pressure on the pressure retention element to maintain the pressure between the minimum pressure level and the maximum pressure level.

16. The non-transitory computer-readable medium of claim 15, wherein the operations further comprise:

receiving, from a surface sensor, a surface sensor output;

inputting, to a pressure control model comprising the physics-based model, the surface sensor output; and updating, using the pressure control model, the feedback signal, and the surface sensor output, the minimum pressure level to contain wellhead pressure.

17. The non-transitory computer-readable medium of claim 16, wherein the operations further comprise:

receiving, from a leak sensor, a leak sensor output;

inputting, to the pressure control model, the leak sensor output;

determining, via the pressure control model and using the leak sensor output, a wellhead overpressure condition; and outputting first commands to cause an overpressure actuator to contain the wellhead pressure, wherein the overpressure actuator is included in an overpressure backup component.

18. The non-transitory computer-readable medium of claim 17, wherein the operations further comprise:

identifying, using the pressure control model and the leak sensor output, a wellhead leak;

quantifying, using the pressure control model and the leak sensor output, a magnitude of the wellhead leak;

classifying, using the pressure control model and the leak sensor output, an event classification corresponding to a severity of the wellhead leak; and outputting second commands to cause the hydraulic actuator and the overpressure actuator to respond to the wellhead leak with an action that is based on the severity of the wellhead leak.

19. The non-transitory computer-readable medium of claim 16, wherein the operations further comprise:

inputting, to a learning module included in the pressure control model, the feedback signal;

generating, by the learning module, a statistical learning model trained using the feedback signal, the statistical learning model trained to contain wellhead pressure; and inputting, to the pressure control model, the statistical learning model.

20. The non-transitory computer-readable medium of claim 19, wherein the operations further comprise:

accessing, from a memory, historical data;

inputting, to the statistical learning model, the surface sensor output and the historical data; and generating, by the learning module, the statistical learning model trained using the feedback signal, the surface sensor output, and the historical data, the statistical learning model trained to contain wellhead pressure.

* * * * *